US007306267B2

(12) United States Patent
Senn

(10) Patent No.: US 7,306,267 B2
(45) Date of Patent: Dec. 11, 2007

(54) BAR LOCK ASSEMBLY AND METHOD FOR ASSEMBLING A BAR LOCK ASSEMBLY TO A PANEL

(75) Inventor: Brian A. Senn, South Milwaukee, WI (US)

(73) Assignee: Powerbrace Corporation, Kenosha, WI (US)

( * ) Notice: Subject to any disclaimer, the term of this patent is extended or adjusted under 35 U.S.C. 154(b) by 144 days.

(21) Appl. No.: 11/099,162

(22) Filed: Apr. 5, 2005

(65) Prior Publication Data

US 2006/0220390 A1 Oct. 5, 2006

(51) Int. Cl.
*E05C 3/04* (2006.01)

(52) U.S. Cl. ..... 292/218; 292/DIG. 32

(58) Field of Classification Search ..... 292/218, 292/DIG. 32, 120; 384/281, 296, 434
See application file for complete search history.

(56) References Cited

U.S. PATENT DOCUMENTS 1,113,209 A * 10/1914 Flaherty ..... 384/434
1,366,132 A * 1/1921 Pitkin ..... 384/297
1,652,468 A * 12/1927 Catlin ..... 384/296
3,756,671 A * 9/1973 White ..... 384/428
4,126,912 A * 11/1978 Johnson ..... 16/81
4,660,872 A * 4/1987 Carson et al. ..... 292/242
4,690,442 A * 9/1987 Reynard ..... 292/218
5,046,770 A * 9/1991 Hansen ..... 292/218
5,718,467 A * 2/1998 Weinerman et al. ..... 292/218
6,149,213 A * 11/2000 Sokurenko et al. ..... 292/340
6,779,818 B2 8/2004 Senn
6,976,701 B2 * 12/2005 Gray et al. ..... 280/728.3

OTHER PUBLICATIONS

3M; 3M VHB Tapes; Tough Applications with proven performance; 9 pages; Copyrighted 1995—2004: USA.
Nitto Denko company; Permacel 500 High Performance Double Coated Adhesive Tape; 1 page; Copyrighted 2000: USA.

* cited by examiner

*Primary Examiner*—Gary Estremsky
(74) *Attorney, Agent, or Firm*—John W. Harbst

(57) ABSTRACT

A bar lock assembly including an elongated operating shaft and a pair of bracket assemblies for securing the operating shaft to a generally flat panel. Cam structure is adapted to be secured to each end of the operating shaft. Each bracket assembly includes a series of components including bearing structure disposed about and intermediate the first and second ends of the shaft and a mounting bracket configured for operable association with the bearing structure to allow for free rotation of shaft about a fixed axis. A coupling maintains the components of the bracket assembly together as a preassembled unit. A method for assembling such a bar lock assembly to a panel is also disclosed.

2 Claims, 6 Drawing Sheets

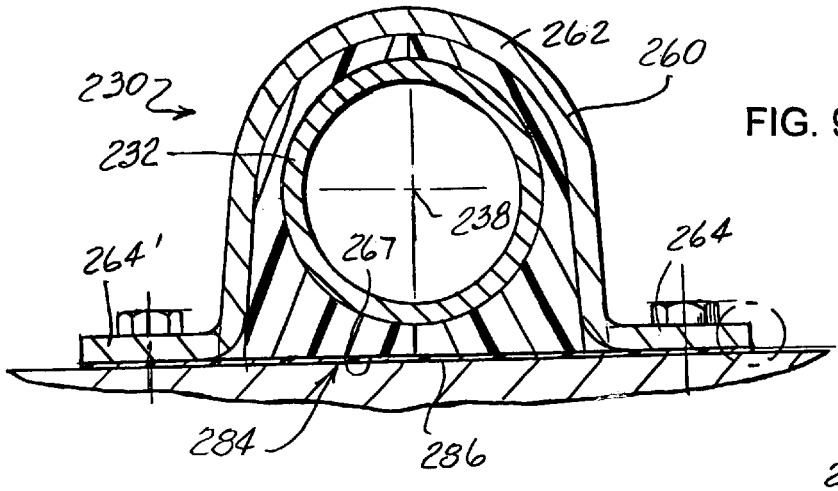
FIG. 9
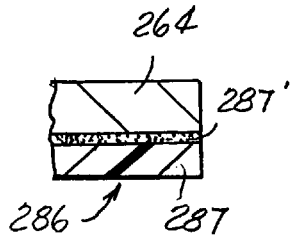
FIG. 10
FIG. 11
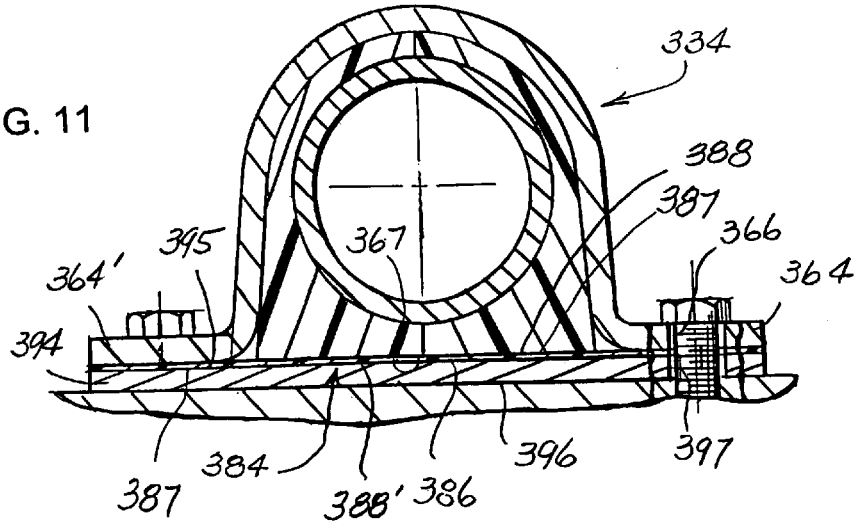

BAR LOCK ASSEMBLY AND METHOD FOR ASSEMBLING A BAR LOCK ASSEMBLY TO A PANEL

FIELD OF THE INVENTION

The present invention generally relates to a bar lock assembly suited to secure doors and other access panels on a trailer, cargo container, and the like and to a method for assembling such a bar lock assembly to a panel.

BACKGROUND OF THE INVENTION

Bar lock assemblies are long tubular closing devices which are in wide spread use on truck and/or semi-trailer doors and panels for adding structural support to the truck or trailer body. Such prior art bar lock assemblies typically include an elongated locking rod having upper and lower latching members or cams fixed to opposite ends of an elongated bar. A pair of vertically spaced bracket assemblies operably secure opposite ends of the locking rod to the truck door or panel for rotation about a fixed axis. A handle is secured toward an intermediate portion of the locking rod so as to rotate the operating bar and, thus, the latching members into and from operable relation with keepers secured to the surrounding frame structure on the semi-trailers, cargo containers and the like.

Prior art bar lock assemblies are relatively cumbersome to install on a truck or semi-trailer panel or door. Each bar lock assembly is comprised of a relatively large number of parts which must be separately handled and installed by an installer. Also, the upper and lower latching members or cams are typically welded to the operating bar. If such welds are affected at the time of final assembly, alignment problems can result and there may be a need to regalvanize the operating bar to reduce corrosion. Alternatively, the latching members or cams and the operating bar may be welded together by the manufacturer. In either form, the fully assembled locking rod has a considerable length making it cumbersome and difficult to assemble in a vertical orientation to the door or panel on the truck or cargo container.

Each bracket assembly used to operably secure one end of the locking rod to the truck door or panel includes a series of individual parts or components. That is, each bracket assembly usually includes a mounting bracket with flanges extending laterally from each side thereof and which is configured to accommodate a bearing used to journal the operating bar of the locking rod. A conventional bearing used to journal the operating bar includes two halves or pieces which interlock relative to each other. Cooperating instrumentalities between the mounting bracket and bearing pieces help prevent the bearing from rotating when the locking rod is turned to lock/unlock the door or panel relative to the surrounding truck or trailer body frame. To further add to the parts comprising the bar lock assembly, a backing plate can be fitted between the flanges on the mounting bracket and the panel or door to which the bar lock assembly is to be secured. As is known, the backing plate can either be of one or two-piece construction. Threaded fasteners or conventional bolt and nut combinations are typically used to fasten or secure the mounting bracket and related parts to the truck or semi-trailer door or panel.

One typical method for installing a bar lock assembly to a door or panel of a truck or trailer involves the following steps or procedures. The bar lock assembly including a locking rod, with locking members or cams already secured to opposite ends of the operating bar, mounting brackets, half-bushings, backing plates and other bracket related hardware are taken from storage bins and staged near a lock rod assembly mounting area. Next, the locking members or cams at opposed ends of each locking rod or operating bar are inserted into operable association with the vertically spaced keepers secured to the surrounding frame of the semi-trailers, cargo containers and the like. This temporarily holds the locking rod or operating bar in vertical position until each bracket assembly can be fastened to the truck or trailer door/panel. Next, four half-bushings are taken from the staging area. Two half-bushings are slipped over each end of the locking rod and are secured together through suitable instrumentalities. Two mounting brackets are thereafter taken from the staging area. A mounting bracket is placed into operable combination with each bearing on the locking rod. If the bar lock assembly includes a backing plate or plates, they are next taken from staging area and positioned between the flanges on the mounting bracket and the truck door or panel to which the bracket assembly is to be secured. Thereafter, each bracket assembly is slid into position along the length of the elongated locking rod.

After each bracket assembly is slid into position along the length of the elongated locking rod, the apertures or holes in the flanges of the mounting bracket are used as a template to mark where the holes are to be drilled in the truck doors or panels for accommodating the fasteners used to securely mount the bracket assembly and, thus, the locking rod to the truck door or panel. It should be appreciated, and especially in those situations where the bracket assembly includes a backing plate disposed between the flanges on the mounting bracket and the truck door or panel, it can be difficult to hold all the bracket assembly parts in assembled relation relative to each other and in a proper vertical position while also trying to concomitantly drill a series of holes through the metal covered truck door or panel.

Requiring a series of fasteners to secure each bracket assembly to the truck door or panel further exacerbates the assembly process. After drilling the holes in the doors, it can be difficult, for one person, to maintain the multiple components comprising the bracket assembly in positional relation relative to each other and in positional relation relative to the drilled holes in the doors or panels while also having to recover, grapple with, position, and then insert the plurality of bolts or fasteners through the openings in the flanges of the mounting bracket and backing plate and, ultimately, into the holes drilled in the doors. As will be understood, this process is then repeated for a second and possibly third, fourth or more bracket assemblies.

Notably, assembling the bar lock unit to the truck or trailer doors or panels frequently takes place in an assembly-line environment. As such, smooth flow of the assembly process with substantially no interruptions is crucial. Inevitably, during the assembly process, parts or components of the bar lock assembly are inadvertently dropped or misplaced, and valuable time is lost by having to replace such dropped or misplaced parts or components. That is, time must be spent returning to the storage bins to retrieve replacement parts. As will be appreciated, having to return to the storage bins to retrieve replacement parts is disruptive and significantly interferes with the desired smooth flow of the assembly process.

Keeping an adequate inventory of the individual pieces and parts comprising the bar lock assembly can also be problematical. Presently, each component comprising the bar lock assembly has independent part numbers associated therewith. Maintaining proper records of the various bar lock assembly components is a tedious, time consuming process. Without maintaining proper records, inventories of the various parts comprising each bar lock assembly can be depleted while inventories of other parts remain satisfactory. In those situations where there are an inadequate number of a specific parts or components comprising the bar lock assembly readily available in the storage bins to complete the assembly process can complicate and sometimes delay the desired smooth flow of assembling the bar lock assemblies to the doors and/or panels of a truck or other cargo container.

Thus, there is a continuing need and desire for a bar lock assembly configured to further facilitate assembly to the truck and/or trailer doors or panels and a method for simplifying shipment of such a bar lock assembly to the trailer manufacturer and the steps involved with inventorying the component parts comprising such bar lock assembly.

SUMMARY OF THE INVENTION

In view of the above, and in accordance with one aspect, there is provided a bar lock assembly including an elongated operating shaft and a pair of bracket assemblies for securing the operating shaft to a generally flat panel. Cam structure is adapted to be secured to each end of the operating shaft. The cam structure, arranged toward each end of the operating shaft, includes an annular lip disposed axially inward from a free end thereof. Each bracket assembly includes a series of components including bearing structure disposed about and intermediate the first and second ends of the shaft and a mounting bracket configured for operable association with the bearing structure to allow for free rotation of shaft about a fixed axis. A coupling is provided for maintaining the components of each bracket assembly including the operating shaft, bearing structure and mounting bracket together as a preassembled unit.

In one form, the mounting bracket of the bracket assembly includes a mid-portion with an apertured flange extending laterally outward from each side of the mid-portion. The flanges on the bracket combine with each other to define a generally planar surface for the mounting bracket.

In one form, the coupling for maintaining the components of the bracket assembly together as a preassembled unit includes adhesive disposed between an interior surface on the mid-portion of the mounting bracket and an exterior of the bearing structure.

As is known, the bracket assembly can also include plate structure to be secured between the planar surface defined by the flanges of the mounting bracket and the generally flat panel to which the bar lock assembly is to be secured. In that embodiment of the bar assembly including plate structure, the coupling secures the plate structure to the flanges of the mounting bracket so as to inhibit the component parts of the bracket assembly from separating from each other.

In one embodiment, the coupling for maintaining the components of the bracket assembly together as a preassembled unit comprises a weld between at least one of the flanges of the mounting bracket and the plate structure, with such a weld being affected after the component parts comprising the preassembled unit are arranged in operable association with the operating shaft. In another form, the coupling for maintaining the components of the bracket assembly together as a preassembled unit includes adhesive for operably securing the plate structure to the planar surface defined by the flanges of the mounting bracket. Alternatively, the coupling for maintaining the components of the bracket assembly together as a preassembled unit includes an adhesive sheet extending across the generally planar surface of the mounting bracket such that the mid-portion of the mounting bracket and the adhesive sheet, after being secured to the flanges of the mounting bracket, are disposed to opposite sides of an axis defined by and combine to encompass a lengthwise portion of the elongated operating shaft therebetween. In yet another form, the coupling for maintaining the components of the bracket assembly together as a preassembled unit includes adhesive operably secured to at least that portion of the planar surface defined by each flange of said mounting bracket. A release sheet is preferably arranged in overlying relation relative to the adhesive operably secured to at least that portion of the planar surface defined by each flange of the mounting bracket.

In accordance with another aspect, there is provided a bar lock assembly including an elongated operating shaft suited for securement to a panel for rotation about a fixed axis by a pair of bracket assemblies. Cam structure is provided at opposed ends of the operating shaft. Each bracket assembly includes bearing structure, disposed about the shaft intermediate the cam structures, and a mounting bracket configured to be positioned about an exterior of the bearing structure to allow for free rotation of the shaft in the bearing structure. Each bracket assembly further includes a coupling for interconnecting the bearing structure, mounting bracket and operating shaft as a preassembled unit prior to installation of the bar lock assembly onto the panel.

To promote its placement about the operating shaft, the bearing structure preferably comprises two bearing pieces operably secured to each other. An outer surface of the bearing structure is configured to inhibit rotation of the bearing structure relative to the mounting bracket. In a preferred embodiment, the bearing structure and the mounting bracket define cooperating instrumentalities for inhibiting axial shifting movements of the bearing structure relative to the mounting bracket. In one form, the mounting bracket includes a mid-portion with an apertured flange extending laterally outward from each side of the mid-portion. The flanges combine with each other to define a generally planar surface for the mounting bracket.

In one preferred embodiment, the coupling for operably maintaining the bearing structure and mounting bracket together as said preassembled unit includes adhesive disposed between an interior surface on the mid-portion of the mounting bracket and an exterior of the bearing structure. In an alternative form, the coupling for operably maintaining the bearing structure and mounting bracket together as said preassembled unit includes an adhesive sheet operably secured to and extending between the flanges of the mounting bracket. In still another form, the coupling for operably maintaining the bearing structure and mounting bracket together as said preassembled unit includes adhesive operably secured to at least that portion of the planar surface defined by each mounting flange of the bracket assembly. Such a coupling further includes a release sheet arranged in overlying relation relative to the adhesive operably secured to at least that portion of the planar surface defined by each mounting flange of the bracket assembly.

Plate structure can also be further included as an another component of the bracket assembly. To promote securement of the bar lock assembly to the door or panel by maintaining the parts of the bar lock assembly together as a preassembled unit, the coupling operably secures the plate structure to the planar surface defined by the flanges of the mounting bracket. The plate structure can include a pair of generally L-shaped brackets. One leg of each L-shaped bracket is suited to cooperate with the annular lip on the cam structure, while another leg of each L-shaped bracket is apertured such that, when the bracket is arranged in operable combination with one of the flanges on the mounting bracket, the aperture defined in that leg of the L-shaped bracket generally aligns with the aperture defined in the respective flange of the mounting bracket. In this arrangement, the coupling for maintaining components of the bar lock assembly together as a preassembled unit preferably includes adhesive disposed between a surface on each apertured leg of the L-shaped brackets and the respective flange on the mounting bracket.

According to another aspect, there is provided, in combination with a cargo-type container having a rectangular access opening with a door pivoted to the container at one side of the opening, a bar lock assembly carried by the door. The bar lock assembly is arranged for operable association with two keeper members secured to the container at opposite sides of the opening. The bar lock assembly includes an elongated operating shaft having first and second ends. Each end of the shaft is provided with cam structure. As is conventional, the cam structure at each end of the operating shaft is adapted to cooperate with a respective keeper member on the container to control the locked condition of the door. Moreover, each cam structure includes an annular lip disposed axially inward from the free end of the cam structure.

A pair of spaced bracket assemblies secure the operating shaft to the door for rotation about a fixed axis. Each bracket assembly includes a series of components including bearing structure disposed about the shaft intermediate the first and second ends thereof and a mounting bracket. Each mounting bracket is configured to fit to an exterior of said bearing structure and allows for free rotation of shaft in the bearing structure. Each bracket assembly further includes a coupling for maintaining the components of the bearing assembly together as a preassembled unit.

According to another aspect, there is provided a method for assembling a bar lock assembly to a panel. Such method involves the steps of: providing an elongated operating shaft with cam structure at opposite ends thereof; providing a pair of mounting bracket assemblies for securing the operating shaft to the panel for rotation about a fixed axis, each mounting bracket assembly being comprised of a plurality of components including bearing structure disposed about the shaft intermediate the first and second ends thereof and a mounting bracket configured to be fitted to an exterior of and capture the bearing structure to allow for free rotation of the shaft in the bearing structure. Another step in the method involves retaining the components comprising each mounting bracket assembly on the shaft as a preassembled unit prior to installation of the bar lock assembly onto said panel.

The step of retaining the components comprising each mounting bracket assembly on the shaft as a preassembled unit preferably includes the step of: coupling the bearing structure and the bracket assembly together so as to retain the bearing structure and mounting bracket on the shaft as said preassembled unit prior to installation of the bar lock assembly onto the panel.

The step of retaining the components comprising each mounting bracket assembly on the shaft as a preassembled unit can alternatively include the step of: securing the bearing structure and the mounting bracket together with adhesive to form the preassembled unit prior to installation of the bar lock assembly onto the panel.

In one form, the mounting bracket of each bracket assembly is preferably provided with a mid-portion configured to accommodate the bearing structure and a flange extending laterally outward from each side of the mid-portion. The flanges combine with each other to define a generally planar surface for the mounting bracket. In this form, the step of retaining the components comprising each mounting bracket assembly on the shaft as a preassembled unit further preferably includes the step of: applying adhesive sheet material to the generally planar surface of the mounting bracket such that the adhesive sheet material is operably secured to and extends between the flanges of the mounting bracket.

Preferably, this aspect also involves the step of providing, as an another component of the bracket assembly, plate structure suited for securement between the planar surface defined by the flanges of the mounting bracket and the panel onto which the bar lock assembly is to be installed. In this form, the method of assembling a bar lock assembly to a panel furthermore preferably includes the step of: coupling the plate structure to the flanges of the mounting bracket to form the preassembled unit prior to installation of the bar lock assembly onto the panel.

In a preferred methodology, the step of coupling the plate structure to the flanges of the mounting bracket involves the step of: fastening the plate structure to the mounting flanges of the mounting bracket to form the preassembled unit prior to installation of the bar lock assembly onto said panel. Alternatively, the step of coupling the plate structure to the flanges of the mounting bracket preferably involves the step of: welding the plate structure to at least one of the flanges of the mounting bracket to form the preassembled unit prior to installation of the bar lock assembly onto the panel. According to another process, the step of coupling the plate structure to the flanges of the mounting bracket preferably involves the step of: adhering the plate structure to at least one flange of the mounting bracket to form the preassembled unit prior to installation of the bar lock assembly onto the panel.

One of the features of the present invention relates to a bar lock assembly comprised of a series of components which are maintained in preassembled relation relative to each other prior to installation of the bar lock assembly onto a door or panel of a truck, cargo container or the like.

Another feature of the present invention relates to maintaining components of a bar lock assembly in preassembled relation relative to each other as to facilitate assembly of the bar lock assembly to a door or panel of truck, cargo container or the like.

Another feature of the present invention relates to maintaining components of a bar lock assembly in preassembled relation relative to each other as to reduce, if not eliminate, separate part bins and part staging areas at locations wherein the bar lock assemblies are to be secured to the door/panel of a truck, trailer, cargo container or the like.

Still another feature of the present invention relates to maintaining components of a bar lock assembly in preassembled relation relative to each other whereby reducing the components that need to individually shipped to the trailer manufacturer, separately inventoried by the trailer manufacturer, and individually handled at the trailer manufacturer.

Yet another feature of the present invention relates to an improved assembly flow yielded by the present invention. Coupling the component parts forming the bracket assembly to the elongated operating shaft can be accomplished in an environment where there is less production pressure on the persons affecting those ends. As will be appreciated, any delay in coupling together the components used to form bar lock assembly will only delay a few operators—at most. Any delay when mounting the bracket assembly to the bar lock unit on a conventional trailer line assembly process can affect a production line with tens or hundreds of operators.

These an additional features, aims and advantages of the present invention will become more readily apparent from the drawings, description of the invention, and the appended claims.

BRIEF DESCRIPTION OF THE DRAWINGS

FIG. 9 is a view similar to FIG. 7 but showing another alternative coupling for maintaining the components comprising the bracket assembly in preassembled relation relative to each other;

FIG. 10 is an enlarged view of that area encircled in phantom lines in FIG. 9;

FIG. 11 is another view similar to FIG. 7 but including plate structure associated with the bracket assembly and showing yet another alternative coupling for maintaining the components comprising the bracket assembly in preassembled relation relative to each other;

DESCRIPTION OF THE INVENTION

Figure 2:
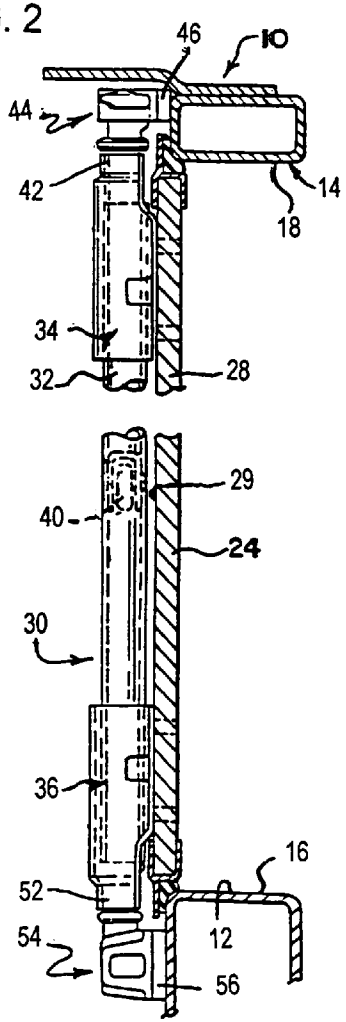
FIG. 2 is a partial sectional view taken along line 2-2 of FIG. 1.

While the present invention is susceptible of embodiment in multiple forms, there is shown in the drawings and will hereinafter be described preferred embodiments of the invention, with the understanding the present disclosure sets forth exemplifications of the invention which are not intended to limit the invention to the specific embodiments illustrated and described.

Figure 1:
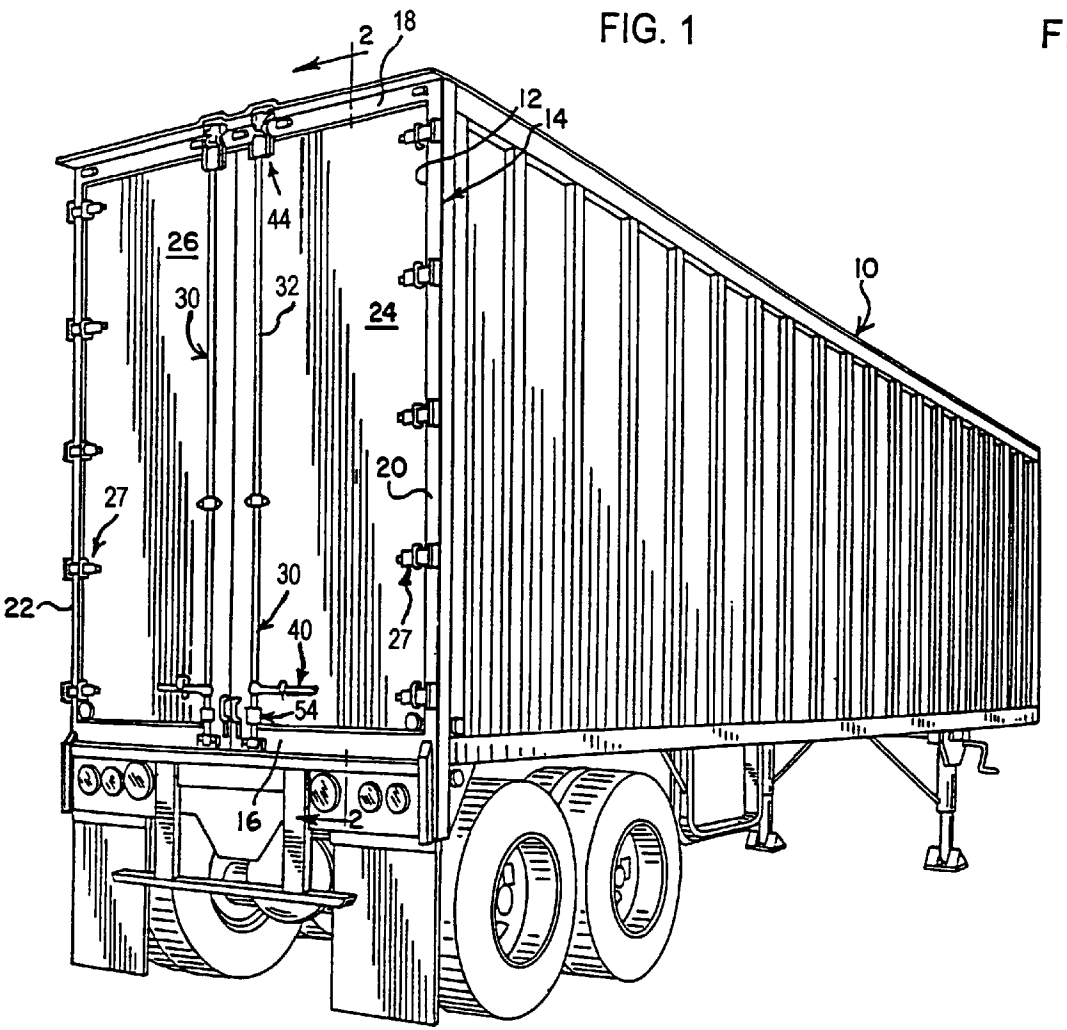
FIG. 1 is a perspective view of one form of enclosed cargo container on which the bar lock assembly of the present invention is used.

Referring now to the drawings, wherein like reference numerals indicate like parts throughout the several views, there is shown in FIG. 1 a conventional enclosed cargo container, generally indicated by reference numeral 10. For exemplary purposes, the enclosed container 10 is illustrated as a semi-trailer truck body but it should be appreciated other forms of enclosed containers are intended to be included within such phraseology as well. In the illustrated embodiment, the container 10 has, at its rear end, a doorway opening 12 for providing access to the interior of the container 10. The doorway opening 12 is defined by a door frame 14 including a horizontal sill 16 extending across a lower edge of the door frame and a horizontal header 18 extending across an upper edge of the door frame. Vertical side frame members 20 and 22 join the sill 16 and header 18 so as to add strength to the door frame 14. Disposed within the door frame 14 for closing and adding further rigidity to the container 10 are a pair of doors or panels 24 and 26. The doors or panels 24 and 26 are connected to the frame members 20 and 22, respectively, with hinges 27 allowing each door 24, 26 to swing within the plane defined by the frame 14. In the exemplary embodiment shown in FIG. 2, each door or panel 24, 26 includes a solid, preferably wood, interior 28 having, on the exterior thereof, a metal cover or plate 29.

As shown, a bar lock assembly 30 is provided, on each door 24,26 for releasably maintaining the respective door 24, 26 in its closed position relative to the frame 14. Each bar lock assembly 30 is disposed adjacent to that edge of the respective door opposite from the hinges 27. Since the bar lock assembly 30 mounted on each door 24, 26 is a mirror image of the other, a description of one bar lock assembly, and the components associated therewith, will suffice as a description of the other bar lock assembly.

Figure 3:
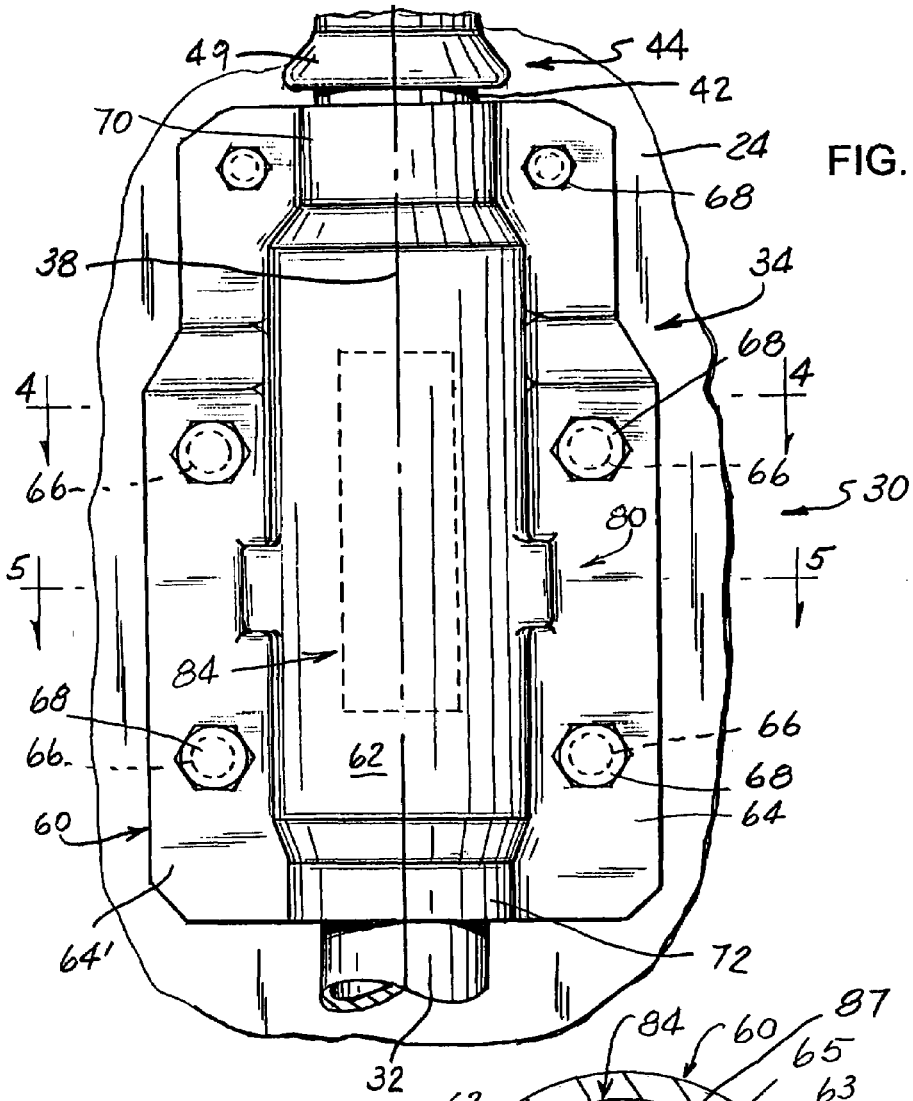
FIG. 3 is an enlarged elevational view of one bracket assembly used in combination with the bar lock assembly of the present invention.

In its illustrated form, each bar lock assembly 30 includes an elongated operating shaft 32 and at least two spaced bracket assemblies 34 and 36 for securing the operating shaft 32 to the generally flat panel or door 24, 26 for rotation about a fixed axis 38 (FIG. 3). Preferably, a handle mechanism 40 is provided by which the operating shaft 32 may be manually rotated or turned.

The operating shaft 32 is preferably tubular in construction to advantageously lighten the weight thereof. At a first or upper end 42, operating shaft 32 includes conventional cam structure 44 having a head portion with a rigid locking finger laterally extending therefrom and configured to cooperate with a keeper 46 secured to the container door frame 14 at one side of the access opening 12. Toward the second or lower end 52, operating shaft 32 includes conventional cam structure 54 having a head portion with a rigid locking finger laterally extending therefrom and configured to cooperate with a keeper 56 secured to the container door frame 14 at the other side of the opening 12. To reduce alignment concerns between therebetween, the cam structures 44 and 54 are preferably secured i.e., welded, to opposite ends of the operating shaft 32 such that when the operating bar 32 is shipped from the manufacturer thereof, the cam structures 44, 54 are an integral part thereof. As will be appreciated by those skilled in the art, the cam structures 44, 54 on each bar lock assembly 30 cooperate in an interengaging relationship with the respective keepers 46, 56 on the frame 14 to assist in aligning the respective door to the frame 14 and to releasably maintain the respective door in a closed position. In the illustrated embodiment, and between the first and second ends 42 and 52, respectively, thereof the elongated operating rod 32 has a generally cylindrical outer configuration.

The cam structures 44, 54 are basically similar in construction. Accordingly, a description of cam structure 44 will equally apply to cam 54. Besides the head portion and locking finger, each cam structure 44, 54 furthermore preferably includes an annular lip 49 disposed axially inward from an axial free end thereof.

Figure 4:
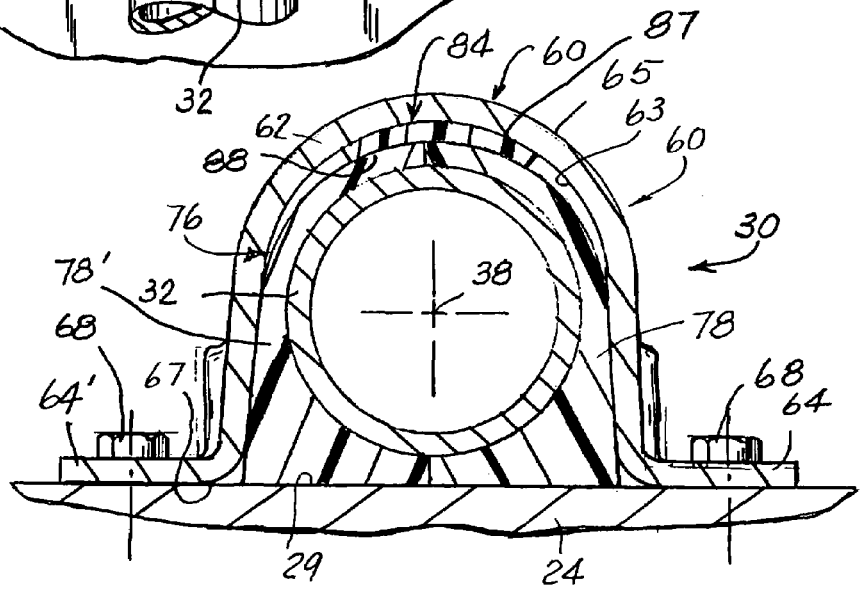
FIG. 4 is a sectional view taken along line 4-4 of FIG. 3.

Preferably, and to simplify the design of the bar lock assembly 30, the bracket assemblies 34 and 36 for mounting the shaft or rod 32 of the bar lock assembly 30 to a respective door or panel 24, 26 are substantially similar in construction and configuration relative to each other. Accordingly, only bracket assembly 34 will be discussed in detail. As shown in FIG. 3, bracket assembly 34 includes a series of components including a guide plate or mounting bracket 60 preferably formed of rigid metal construction and having a generally semi-cylindrical vertically disposed mid-portion 62 along with a pair of side flanges 64 and 64' laterally extending from opposed sides of the mid-portion 62. As shown in FIG. 4, the flanges 64, 64' of mounting bracket 60 combine with each other to define a generally planar surface 67 for the respective mounting bracket. Moreover, and as further shown in FIG. 4, the mid-portion 62 of each mounting bracket 60 includes an exterior surface 63 and an interior surface 65.

Preferably, each flange 64, 64' of bracket 60 defines a series of vertically spaced apertures or openings 66 for permitting conventional fasteners 68 to pass therethrough. In an alternative form, and without departing from the spirit and scope of the invention, each flange 64, 64' of a respective bracket assembly 34, 36 can be provided with a series of locating studs which are preferably externally threaded. Such locating studs can be welded or otherwise secured in place and project in a direction generally normal to the planar surface 67 of the respective bracket. Suffice it say, the fasteners 68 and/or studs are used to secure the respective mounting bracket to the exterior metal cover or plate 29 on the respective door or panel thereby securing one end of the bar lock assembly 30 in position on the respective door or panel while allowing for rotation of the operating shaft 32 about the fixed axis 38.

In the embodiment illustrated in FIG. 3, axially spaced end portions 70 and 72 of the semi-cylindrical mid-portion 62 of the mounting bracket 60 have a reduced diameter from the remainder of the mid-portion 62. Suffice it to say, and for purposes discussed below, the reduced end portions 70, 72 are configured to fit about the elongated rod 32 but are somewhat smaller than the radius defined by the annular lip 49 of the respective cam structure provided toward the adjacent end of the operating shaft 32.

To promote rotation of the operating shaft 32 about axis 38 and relative to the mounting bracket assemblies 34 and 36, and as shown in FIG. 4, bearing structure 76 is provided as an another individual component of each bracket assembly 34, 36 between the operating shaft 32 and the interior surface 63 of the mid-portion 62 of the mounting bracket 60. In the illustrated embodiment, and to facilitate placement of the bearing structure 76 between the first and second ends of and about a lengthwise section of an operating shaft 32 having cam structures 44 and 54 (FIG. 2) already secured thereto, bearing structure 76 is preferably comprised of bearing pieces or halves 78 and 78' which are operably interconnectable to each other through any conventional means so as to surround a lengthwise portion of the operating shaft 32 therebetween.

Figure 5:
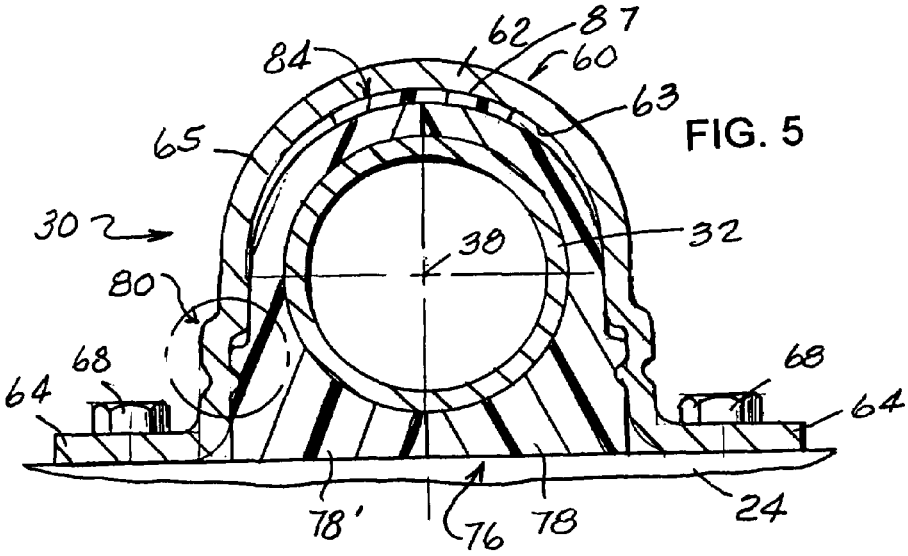
FIG. 5 is a sectional view taken along line 5-5 of FIG. 3.
Figure 6:
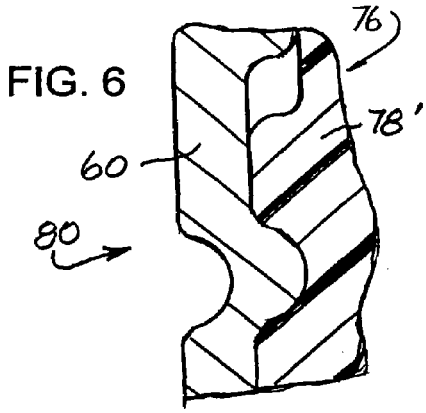
FIG. 6 is an enlarged view of that area encircled in phantom lines in FIG. 5.

In a preferred form, the bearing pieces or halves 78 and 78' are formed of non-metallic material, i.e. nylon, plastic or other any other suitable material. In one form, the bearing pieces or halves 78 and 78 of bearing structure 76 establish a relatively snug fit about a lengthwise portion of the shaft 32 while permitting manual rotation of the shaft 32 about axis 38. In the exemplary embodiment illustrated in FIGS. 5 and 6, each mounting bracket 60 and bearing structure 76 further define cooperating instrumentalities 80 for: promoting axial placement of the bearing structure 76 relative to the mid-portion 62 (FIG. 3) of the mounting bracket 60; inhibiting free axial shifting movements between the bearing structure 76 and respective mounting bracket along the length of the shaft 32 (FIG. 3); and, inhibiting turning movement of the bearing structure 76 with rotation of the shaft 32 (FIG. 3).

A coupling 84 is provided for operably maintaining the components of each bracket assembly including mounting bracket 60, bearing structure 76, and the operating shaft 32 together as a preassembled unit. In the embodiment illustrated in FIGS. 3 through 5, coupling 84 includes a strip of high strength, double coated, preferably acrylic foam tape 86. A tape sold by 3M Corporation under the tradename VHB™ Acrylic Foam Tape is one example of a product which would serve the intended purpose. Preferably, adhesive 87 on one side of the coupling or tape 86 adheres to the interior surface 63 of the mid-portion 62 of each mounting bracket while adhesive 88 on a second side of the tape 86 adheres to and couples the bearing structure 76 to the mounting bracket 60 thereby inhibiting inadvertent separation of the bar lock assembly components including operating shaft 32, mounting bracket 60 and bearing structure 76. In the exemplary embodiment, the adhesive tape 86 is positioned on the interior surface 63 of the mid-portion 62 of mounting bracket 60 such that a portion of the tape 86 preferably adheres to both halves or pieces 78 and 78' of the bearing structure 76.

Figure 8:
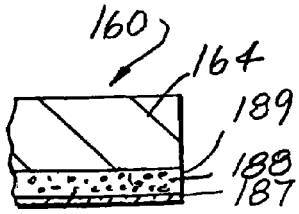
FIG. 8 is an enlarged view of that area encircled in phantom lines in FIG. 7.
Figure 7:
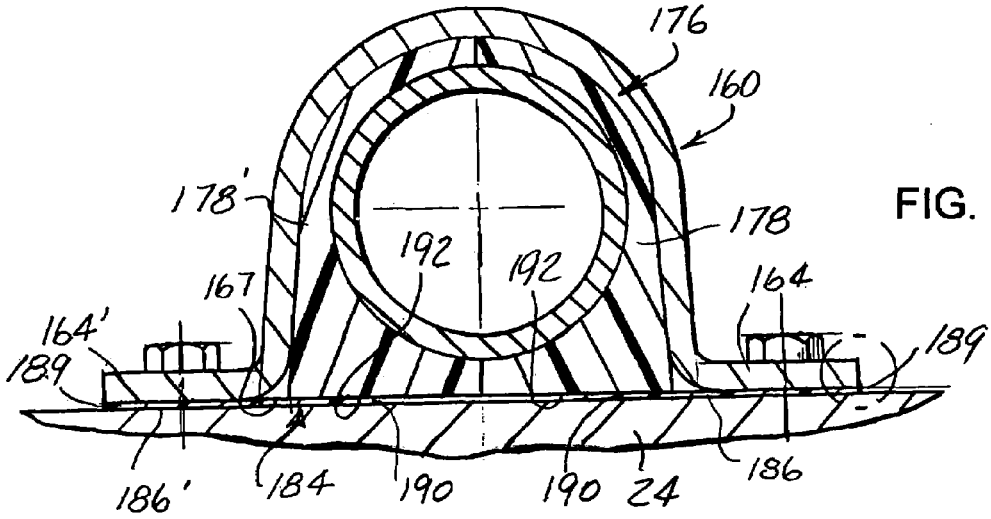
FIG. 7 is a view similar to FIG. 4 but showing an alternative coupling for maintaining the components comprising the bracket assembly in preassembled relation relative to each other.

FIGS. 7 and 8 illustrate an alternative form for the coupling used to maintain multiple components of the bar lock assembly together as a preassembled unit. This alternative form of coupling is designated by reference numeral 184. The other components of the bar lock assembly, functionally analogous to those components discussed above regarding bar lock assembly 30, are designated with reference numerals identical to those used above with the exception the components shown in FIGS. 7 and 8 use reference numerals in the 100 series.

In the form shown in FIG. 7, coupling 184 includes two elongated strips of adhesive tape 186 and 186'. Preferably, the tape strips 186, 186' are substantially identical in construction and, thus, only tape strip 186 will be discussed in detail. As shown in FIG. 8, each adhesive tape preferably includes an elongated strip of polyester, plastic, nylon or other suitable material 187 with adhesive 188 on one side thereof. The adhesive 188 on the one side of each strip 186, 186' adheres to that portion of the generally planar surface 167 defined by the flanges 164, 164', respectively, of the mounting bracket 160. In one form, each tape strip 186, 186' extends along substantially the entire length of the respective flange 164, 164', respectively. Of course, each tape strip 186, 186' could extend for a length less than the length of the respective flange 164, 164' or could comprise a plurality of adhesive strips arranged along the length of each flange 164, 164' without detracting or departing from the spirit and scope of the invention.

Preferably, edge 189 of each strip 186, 186' laterally extends proximate to an outer edge of the respective flange 164, 164' to which each strip 186, 186' is adhered. As shown in FIG. 7, an inner edge 190 of each adhesive strip 186, 186', at least partially, underlies and is adhered to a surface 192 of the pieces 178, 178' comprising bearing structure 176 whereby maintaining the multiple components of the bar lock assembly 130 together as a preassembled unit.

FIGS. 9 and 10 illustrate an alternative form for the coupling used to maintain multiple components of the bar lock assembly together as a preassembled unit. This alternative form of coupling is designated by reference numeral 284. The other components of the bar lock assembly, functionally analogous to those components discussed above regarding bar lock assembly 30, are designated with reference numerals identical to those used above with the exception the components shown in FIGS. 9 and 10 use reference numerals in the 200 series.

In the form shown in FIG. 9, coupling 284 preferably includes an adhesive sheet 286. In one form, and as shown in FIG. 10, the adhesive sheet 286 includes a relatively thin, tear resistant sheet 287 formed from polyester, plastic, nylon or any other suitable material which is preferably sized to substantially correspond to the planar surface area 267 defined by the mounting flanges 264, 264' of mounting bracket 260. Suitable adhesive material 287' covers one side of the sheet 286. The other side of the sheet 286 is preferably free of adhesive material. Preferably, the adhesive 287' on sheet 286 adheres to the generally planar surface 267 defined by the flanges 264, 264', respectively, of the mounting bracket 260.

As shown in FIG. 9, the adhesive sheet 286 extends between the flanges 264, 264' of the mounting bracket 260 and across, at least a portion of, the generally planar surface 267 and is disposed to one side of the axis 238 about which shaft 232 turns or rotates. The mid-portion 262 of the mounting bracket 260 limits movement of the elongated shaft 232 on the opposite side of the axis 238 about which shaft 232 turns or rotates. As such, that lengthwise portion of the operating shaft 232 extending therebetween is encompassed by sheet 286 and the mid-portion 262 of mounting bracket 260. As should be appreciated, such an arrangement maintains the multiple components of the bar lock assembly 230 together as a preassembled unit.

FIG. 11 illustrates another form for the bracket assembly used to secure a bar assembly to a door or panel and an alternative form of coupling used to maintain multiple components of the bar lock assembly together as a preassembled unit. This alternative form of bracket assembly is designated by reference numeral 334. The alternative form of coupling shown in FIG. 11 is designated by reference numeral 384. The other components of the bar lock assembly, functionally analogous to those components discussed above regarding bar lock assembly 30, are designated with reference numerals identical to those used above with the exception the components shown in FIG. 11 use reference numerals in the 300 series.

In the bracket assembly embodiment illustrated in FIG. 11, plate structure 394 is added as another component to the other multiple components comprising the bracket assembly 334. As is known, plate structure 394 is occasionally provided as an additional component to each bracket assembly of the bar lock assembly 330 to enhance the sealing capability of the respective door/panel relative to the frame of the container.

As shown in FIG. 11, plate structure 394 is adapted and configured to be secured between the planar surface 367 defined by the flanges 364, 364' of the mounting bracket 360 and the generally flat panel or door to which the bar lock assembly 330 is to be secured or fastened. In one form, plate structure 394 is formed of rigid metal, i.e., steel, and includes first and second generally parallel and generally planar surfaces 395 and 396, respectively, along with a series of openings or holes 397 (with only one opening being shown) which align with the apertures or openings 366 in the side flanges 364 and 364' of the mounting bracket 360.

Coupling 384, as shown in FIG. 11, serves to operably secure the metal plate structure 394 against the flanges 364, 364' of the mounting bracket 360 whereby maintaining the multiple components of the bar lock assembly 330, including plate structure 394, together as a preassembled unit. In the form shown in FIG. 11, coupling 384 includes an acrylic non-woven tissue sheet 386 with adhesive 387 on opposed sides 388 and 388' thereof. An adhesive tape or sheet sold by Nitto Denko Company under Model No. 500 is one example of an adhesive sheet which would serve the intended purpose. Preferably, adhesive 387 on one side 388 of sheet 386 adheres to the side flanges 364, 364', respectively, of the mounting bracket 360. Adhesive 387 on the opposite side 388' of sheet 386 adheres to surface 395 of plate structure 394 thereby maintaining the plate structure 394 in operable combination with the remaining components of the respective bracket assembly.

In the form shown, the adhesive sheet 386 is preferably sized relative to the surface 367 defined by the flanges 364, 364' of bracket 360. It should be appreciated, however, alternative configurations for the coupling 384 are equally applicable without detracting or departing from the spirit and scope of the present invention. For example, coupling 384 could include applying an elongated strip of double coated adhesive tape to each of the flanges 364, 364' of the mounting bracket 360. As mentioned, a tape sold by 3M Corporation under the tradename VHB™ Acrylic Foam Tape is one example of a tape which would serve the intended purpose. Preferably, one side of each adhesive strip can adhere to that portion of the generally planar surface 367 defined by each flange 364, 364' of the mounting bracket 360. The other adhesive side of each strip can be secured to the generally planar surface 395 of the plate structure 394. As should be appreciated, such an arrangement likewise would serve to maintain the multiple components of the bar lock assembly 330, including plate structure 394, together as a preassembled unit.

Figure 12:
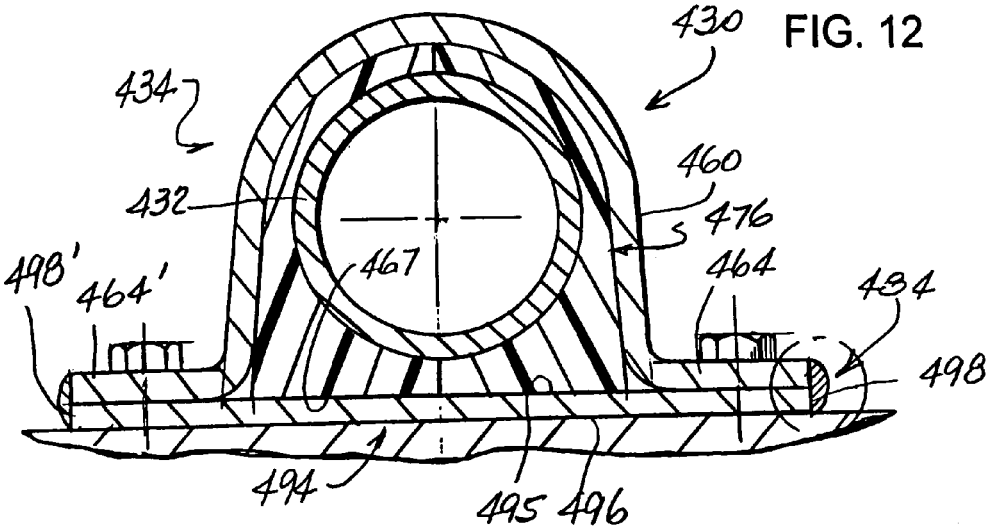
FIG. 12 is another view similar to FIG. 11 but showing still another alternative coupling for maintaining the components comprising the bracket assembly in preassembled relation relative to each other.
Figure 13:
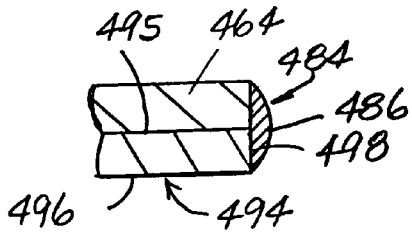
FIG. 13 is an enlarged view of that area encircled in phantom lines in FIG. 12.

FIGS. 12 and 13 illustrate another bracket assembly, including a backing plate or plate structure, used to secure a bar lock assembly to a door and an alternative form of coupling for maintaining the components of the bar lock assembly together as a preassembled unit. This alternative form of bracket assembly is designated by reference numeral 434. The alternative form of coupling is designated by reference numeral 484. The other components of the bar lock assembly, functionally analogous to those components discussed above regarding bar lock assembly 30, are designated with reference numerals identical to those used above with the exception the components shown in FIGS. 12 and 13 use reference numerals in the 400 series.

In the bracket assembly embodiment illustrated in FIG. 12, plate structure 494 is adapted and configured to be secured between the planar surface 467 defined by the flanges 464, 464' of the mounting bracket 460 and the generally flat panel or door to which the bar lock assembly 430 is to be secured or fastened. In one form, plate structure 494 includes first and second generally parallel and generally planar surfaces 495 and 496, respectively, along with a series of openings or holes (not shown) which align with those apertures or openings in the side flanges 464 and 464' of the mounting bracket 460 as discussed above. Notably, in the embodiment illustrated in FIG. 12, and as is conventional, the plate structure 494 extends across the planar surface 467 of the mounting bracket 460 and is preferably configured such that side edges 498, 498' thereof terminate in generally superposed relationship with the terminal edges of the flanges 464, 464' when plate structure 494 is arranged in underlying relation relative to the mounting bracket 460.

In the form shown in FIGS. 12 and 13, coupling 484 preferably includes a weld 486 extending along one or both of the terminal side edges of the plate structure 494 and the terminal edges of one or both flanges of the respective mounting bracket 460. The weld 486 for coupling the plate structure 494 to the mounting bracket 460 can extend along the entirety of one or both side edges of plate structure 494 or constitute one or more spot welds extending along a portion of one or both side edges of the plate structure 494 and the respective side flange 464, 464' of the mounting bracket 460. Suffice it to say, the purpose of coupling 484 is to maintain the components of the bar lock assembly 430, including operating shaft 432, the mounting bracket 460, bearing structure 476, and plate structure 494, together as a preassembled unit.

Figure 14:
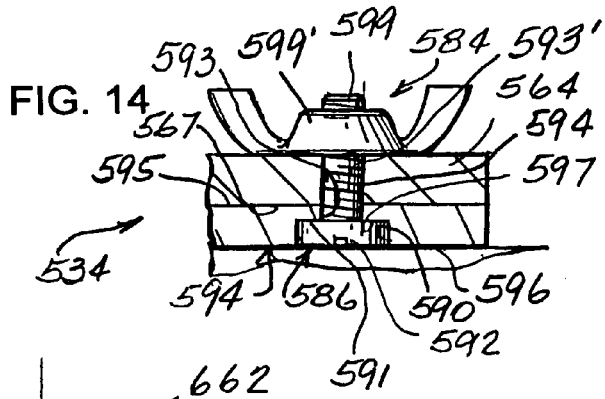
FIG. 14 is an enlarged fragmentary sectional view showing another alternative coupling for maintaining the multiple components comprising the bracket assembly in assembled relation relative to each other.

FIG. 14 partially illustrates another bracket assembly, including a backing plate or plate structure, used to secure a bar assembly to a door or panel and an alternative form of coupling for maintaining the components of the bar lock assembly together as a preassembled unit. This alternative form of bracket assembly is designated in FIG. 14 by reference numeral 534. The alternative form of coupling shown in FIG. 14 is designated by reference numeral 584. The other components of the lock rod that are functionally analogous to those components discussed above regarding assembly 30 are designated with reference numerals identical to those used above with the exception the components shown in FIG. 14 use reference numerals in the 500 series.

In the bracket assembly embodiment illustrated in FIG. 12, plate structure 594 is adapted and configured to be secured between the planar surface 567 defined by the flanges (with only one being shown) of the mounting bracket 560 and the generally flat panel or door to which the bar lock assembly 530 is to be secured or fastened. In this form, plate structure 594 includes first and second generally parallel and generally planar surfaces 595 and 596, respectively, along with a series of openings or holes (not shown) which are adapted to align with those apertures or openings (not shown) in the side flanges of the mounting bracket 560 as discussed above. In the embodiment shown in FIG. 14, and as is conventional, the plate structure 594 extends across the planar surface 567 of the mounting bracket 560 and at least partially underlies the flanges 564, 564' of the mounting bracket 560.

In the form shown in FIG. 14, coupling 584 preferably comprises a fastener 586 including a threaded bolt 599 and nut 599' combination. In one form, and besides those holes or openings adapted to aligned with the apertures or openings in the flanges of the mounting bracket 560, plate structure 594 further defines a counterbore 590 for accommodating the fastener 586. As shown, counterbore 590 includes an enlarged portion 591 extending from the surface 596 toward surface 595 and defines a shoulder 597. The enlarged portion 591 of counterbore 590 is configured to accommodate a head portion 592 of the threaded bolt 599.

Preferably, the enlarged portion 591 of counterbore 590 and the head portion 592 of the bolt or fastener 599 are each configured such that when the threaded bolt 599 and nut 599' combination are tightly secured to each other, one side of the head portion 592 of the threaded bolt 599 is even with or recessed from surface 596 of the plate structure 594 whereby allowing surface 596 of plate structure 594 to be arranged in generally flush or abutting relationship with the exterior of the door/panel to which the mounting bracket is to be secured or fastened. As will be appreciated, the other side of the head portion 594 abuts with and is limited by the shoulder 597 as the threaded bolt 599 and nut 599' combination are tightly secured to each other.

As shown, the head portion 592 of the fastener 599 is configured in a conventional fashion to accommodate a suitable tool (not shown) used to either rotate the fastener into secured relation with the respective nut 599' or to hold the head portion 592 of the fastener 599 against turning as nut 599' is secured thereto. Alternatively, and without detracting from the spirit of the invention, the enlarged portion 591 of counterbore 590 can be configured to combine with and inhibit the head portion 592 of the fastener 599 from turning or rotating as the nut 599' is secured thereto.

In the illustrated embodiment, counterbore 590 further includes a reduced diameter portion 593 which, in the illustrated embodiment, is axially aligned with the enlarged portion 591 of bore 590 and is configured to allow a shank portion 594 of the threaded fastener 599 to extend therethrough. In the illustrated embodiment, at least one mounting flange 564 of the mounting bracket 560 defines a throughbore 593' which, when plate structure 594 is positioned in operable combination with the mounting bracket 560, aligns with the reduced diameter portion 593 of bore 590 to allow the shank portion 594 of fastener 599 to extend therethrough. As will be appreciated, after the shank portion 594 of fastener 599 passes through the reduced diameter portion 593 of counterbore 590 and the axially aligned bore 593' in the respective mounting flange 564 of bracket 560, nut 599' is secured thereto, thus, fastening the components comprising bar lock assembly 530, including plate structure 594, together as a preassembled unit.

Figure 15:
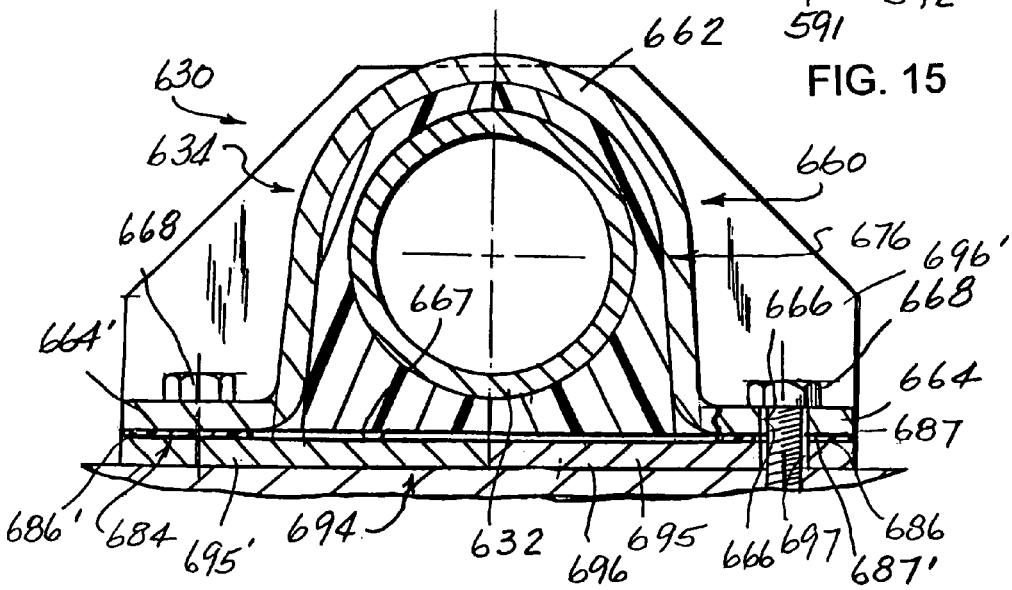
FIG. 15 is yet another view similar to FIG. 11 showing alternative plate structure arranged in operable combination with the bracket assembly along with another alternative coupling for maintaining the multiple components comprising the bracket assembly in assembled relation relative to each other.
Figure 16:
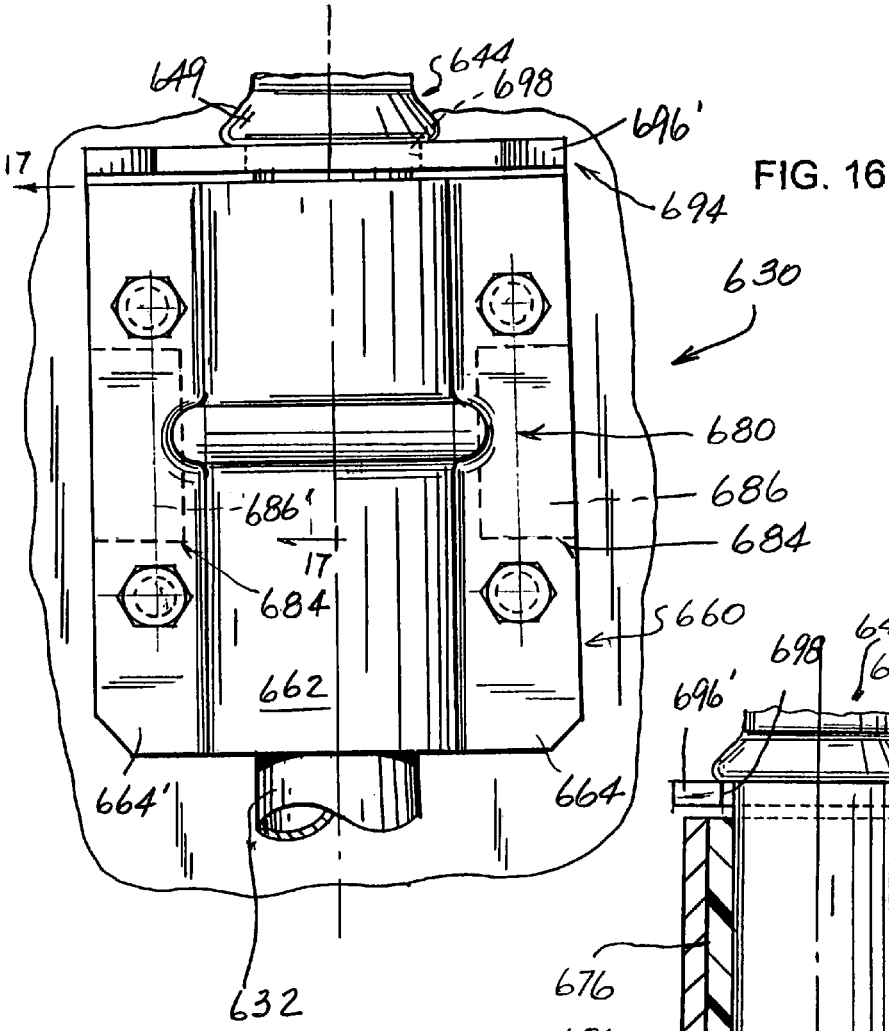
FIG. 16 is an elevational view of the bracket assembly shown in FIG. 15.
Figure 17:
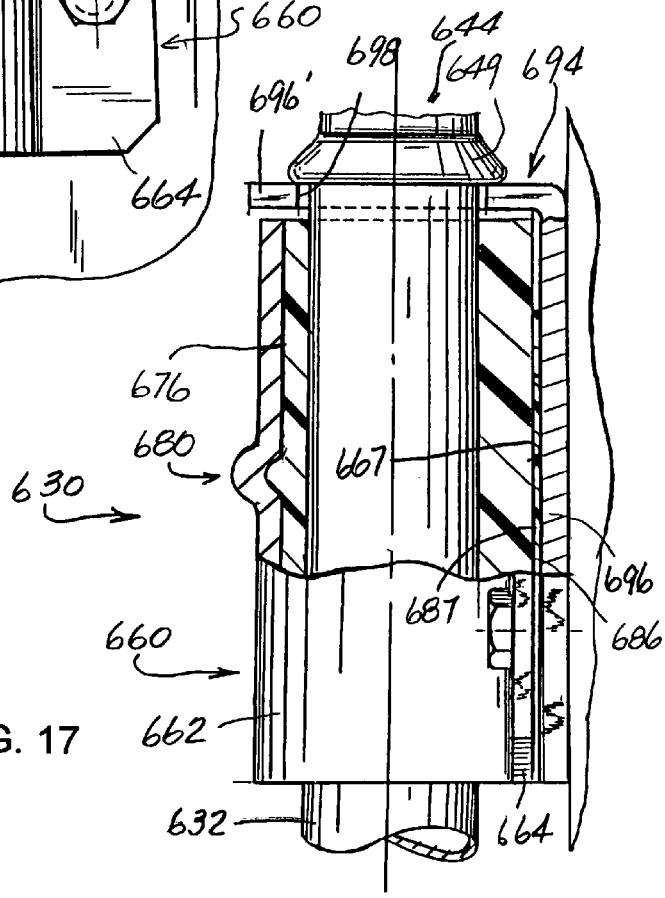
FIG. 17 is a partial sectional view taken along line 17-17 of FIG. 16.

FIGS. 15, 16 and 17 illustrate another bracket assembly, including a backing plate or plate structure, of a lock rod assembly and an alternative form of coupling for maintaining the components of the bar lock assembly together as a preassembled unit. This alternative form of bracket assembly is designated in FIGS. 15, 16 and 17 by reference numeral 634. The alternative form of coupling shown in FIGS. 15, 16 and 17 is designated by reference numeral 684. The other components of the bar lock assembly, functionally analogous to those components discussed above regarding bar lock assembly 30, are designated with reference numerals identical to those used above with the exception the components shown in FIGS. 15, 16 and 17 use reference numerals in the 600 series.

In the embodiment shown in FIG. 15, the guide plate 660 for each bracket assembly is formed of rigid metal construction and preferably has a generally semi-cylindrical mid-portion 662 along with a pair of side flanges 664 and 664' laterally extending from opposed sides of the mid-portion 662. As shown in FIG. 15, the flanges 664, 664' of mounting bracket 660 combine with each other to define a generally planar surface 667 for the respective mounting bracket.

Preferably, each flange 664, 664' of guide plate or bracket 660 defines a series of spaced apertures or openings 666 (with only one being shown) for permitting conventional fasteners 668 to pass therethrough. As mentioned above, a series of externally threaded studs (not shown) can alternatively extend generally normal to surface 667 and serve the same purpose as fasteners 668. Suffice it say, the fasteners 668 and/or studs are used to secure the respective mounting bracket to the exterior metal cover or plate on the respective door or panel thereby securing one end of the bar lock assembly 630 in position on the respective door or panel while allowing for rotation of the operating shaft 632 about the fixed axis 638.

As discussed above, bracket 660 of each bracket assembly along with the bearing structure 676 preferably define cooperating instrumentalities 680 (FIGS. 16 and 17 ) therebetween for: promoting axial placement of the bearing structure 676 relative to the mid-portion 662 of the bracket 660; inhibiting free axial shifting movements between the bearing structure 676 and respective mounting bracket along the length of shaft 632; and, inhibit free turning movements of the bearing structure 676 with rotation of shaft 632. In the embodiment shown in FIG. 16, however, and unlike guide plate 60, the mid-portion the guide plate 660 does not include end portions having reduced diameters. Alternatively, plate structure 694 is preferably arranged in operable combination with the guide plate 660 and the adjacent cam structure on the bar lock assembly for effecting alignment of the door/panel relative to the frame opening and providing an anti-rocking effect to the container in a manner described below.

In the form illustrated in FIGS. 15 through 17, plate structure 694 preferably includes a pair of side-by-side brackets 695 and 695' formed from a relatively rigid metal, i.e. steel. In one form, the brackets 695 and 695' are mirror images of each others and, thus, only bracket 695 will be discussed in detail. As shown, bracket 695 has a generally L-shaped configuration including two leg portions 696 and 696' arranged in generally normal relation relative to each other. Leg portion 696 of bracket 695 is adapted and configured to be secured between the respective side or mounting flange 664 of the mounting bracket 660 and the generally flat panel or door to which the bar lock assembly 630 is to be secured. In the illustrated embodiment, leg portion 696 of bracket 695 extends the length of the respective side or mounting flange on the mounting bracket 660 and has a width generally equal to about one-half the width of the mounting bracket 660. Suffice it to say, the leg portion 696 of bracket 695 is configured such that, when arranged in operable combination with the mounting bracket 660, a widthwise portion thereof extends beneath the bearing structure 676. As shown, leg portion 696 of bracket 695 includes a series of holes or openings 697 (with only one being shown in FIG. 15) which align with those apertures or openings 666 in the respective side flanges 664 of the mounting bracket 660.

Leg portion 696' of bracket 695 rigidly extends from leg portion 696 and defines a generally semi-circular recess 698 between opposed edges thereof. Suffice it to say, when plate structure 694 is secured in place, the recess 698 extends around about one-half the diameter of the elongated shaft 632 of the bar lock assembly 630. Notably, and as shown in FIG. 16, the semi-circular recess 698 defined by the leg portion 696' of each bracket 695, 695' has a smaller radius than is the effective radius defined by the annular lip or ring 649 defined by an adjacent cam structure 644 on the operating shaft 632.

In the form shown in FIGS. 15 and 16, coupling 684 preferably includes two elongated strips of adhesive tape 686 and 686'. Preferably, the strips 686, 686' are substantially identical in construction and, thus, only strip 686 will be discussed in detail. Each adhesive tape strip preferably includes a high strength, double coated tape. The above-mentioned tape sold by 3M Corporation under the tradename VHB™ Tape is one example of a product which would serve the intended purpose. Alternatively, an adhesive tape or strips cut from sheet material of the type mentioned above and sold by Nitto Denko Company under Model No. 500 is another example of an adhesive which would serve the intended purpose. In either instance, adhesive 687 on one side of the coupling tape 686 adheres to that portion of the underside of each flange 664, 664' of bracket 660. Adhesive 687 on the other side of each tape 686 adheres to the leg portion 696 of bracket 695. In one form, each adhesive strip 686, 686' extends along a lengthwise portion of the respective flange 664, 664', respectively. Of course, each double sided tape strip 686, 686' could extend the entire length of the respective flange 664, 664'. Moreover, each tape strip 686, 686' can be comprised of a plurality of adhesive strips arranged along the length of each flange 664, 664' without detracting or departing from the spirit and scope of the invention. Suffice it to say, and as shown in FIGS. 15 through 17, the adhesive strips 686 and 686' comprising coupling 684 serve to maintain the multiple components of the bar lock assembly 630 including shaft 632, bracket 660, bearing structure 676, and the plate structure 694 together as a preassembled unit.

To unlock the door or panel 24, the handle mechanism 40 is released from its locked position or condition and swung outwardly such that the operating shaft 32 of the bar lock assembly 30 mounted to the door or panel 24 is caused to rotate or turn about axis 38. The operating shaft 32 of the respective bar lock assembly 30 is turned until the locking fingers on the cam structures 44, 54 at opposed ends of the respective bar lock assembly 30 are ultimately removed from operable association with their respective stationary keepers 46, 56. Thereafter, the door or panel 24 can be swung outwardly of the plane of the door frame 20 to an open position. The door or panel 26 may be unlocked and opened in a corresponding manner.

In closing the door or panel 26, it is first swung to a position generally in the plane of the door frame 20. The handle mechanism 40 is then rotated or turned whereupon the operating shaft 32 of the respective bar lock assembly 30 is rotated so as to cause the locking fingers on the cam structures 44, 54 at opposed ends of the respective bar lock assembly 30 are moved into operable association with their stationary respective keepers 46, 56. After the locking fingers on the cam structures 44, 54 are disposed in full locking engagement with their respective keepers 46, 56, the handle mechanism 40 is again secured in a locked condition or position. Thereafter, the door or panel 24 may be unlocked and opened in a corresponding manner.

As each door or panel 24, 26 is being closed, their can be some misalignment between the doors or panels 24, 26 and the opening 12 in the door frame 20. In a preferred form, and as the operating shaft of the respective bar locking mechanism is turned or rotated to close the door, the annular ring or lip on the respective cam structures cooperate in a well known manner with the reduced diameter end portions on either mounting bracket of the bracket assemblies, respectively, or, in those bracket assemblies so configured, with a leg portion of the plate structure component of the bracket assemblies, to affect alignment of the doors or panels 24, 26 relative to the opening 12 in the door frame 20. As will be appreciated by those skilled in the art, and after the door 24, 26 is in a closed position, the annular ring or lip on each cam structure continues to cooperate with the mounting bracket or plate structure of the respective bracket assembly to resist vertical racking movements between the doors 24, 26 relative to the door frame 20 and add structural support to the cargo container.

The bar lock assembly of the present invention has been designed to minimize assembly costs and shipping concerns while reducing inventorying requirements. With the present invention, the bracket assemblies disposed at opposed ends of the bar lock assembly are mounted as a preassembled unit with the operating shaft. Accordingly, and after the bracket assembly is slid into the desired axial position along the operating shaft, the appropriate placement of the holes for the mounting bracket can be marked on the door or panel 24, 26 without having to balance and maintain multiple components of each bracket assembly in place since, with the present invention, the multiple components comprising each bracket assembly are already coupled to each other and, thus, maintained in preassembled relation relative to each other.

With the present invention, when mounting the bar lock assembly to the door or panel 24, 26, only a one-piece assembly must be handled, not including the fasteners. By reducing the number of parts required to be individually handled during the assembly process, the costs of assembling each bar lock assembly to the door or panel 24, 26 is expected to likewise be reduced. As will be appreciated, designing the bar lock assembly with preassembled bracket assemblies at opposed ends thereof, eliminates the need for separate part bins and part staging areas at the lock rod installation area. Moreover, since the parts of the bar lock assembly are preassembled relative to each other, including backing plate structure, the likelihood of individual components or pieces separating from each other is reduced, thus, significantly reducing the frustration of having to return to a staging area to retrieve lost or misplaced components.

With the present invention, the mounting bracket assemblies and operating shaft 32 are maintained in preassembled relation relative to each other. Accordingly, a single part number can be assigned to the preassembled unit. Thus, a bar lock assembly having a single part number needs to be shipped to the trailer manufacturer. Moreover, a bar lock assembly having only a single part number comprised of multiple component parts coupled together as a preassembled unit needs to be handled and inventoried at the trailer manufacturer.

With the present invention, the bar lock assembly, having premounted bracket assemblies thereon, can take place in an environment where there is less production pressure compared to an assembly line process at a trailer manufacturer. As such, any delay involved with premounting the bracket assemblies 34, 36 to the operating shaft 32 will only delay a few operators at most. Comparatively, and as mentioned above, any delay involved with mounting the bracket assemblies 34, 36 to the operating shaft 32 on a trailer assembly line at a trailer manufacturer can affect a production line involving tens of hundreds of workers.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A bar lock assembly, comprising:

an elongated operating shaft having cam structure secured to opposed ends thereof, said cam structure including an annular lip disposed axially inward from a free end of said cam structure; and a pair of bracket assemblies for securing said operating shaft to a panel for rotation about a fixed axis, with each bracket assembly including bearing structure disposed about the shaft intermediate the cam structure at opposed ends of said operating shaft, and wherein said bracket assembly further includes a mounting bracket configured to be positioned relative to an exterior of said bearing structure and allows for free rotation of the shaft in the bearing structure, with each bracket assembly further includes plate structure for securement between the flanges of said mounting bracket and the panel to which said bar lock assembly is to be secured, and wherein said plate structure comprises a pair of generally L-shaped brackets, with one leg of each L-shaped bracket defining an aperture adapted to be arranged in general alignment with an aperture in one of the flanges on said mounting bracket, and wherein the other leg of each L-shaped bracket is disposed in confronting relation relative to the annular lip on said cam structure, and wherein said bracket assembly further includes a coupling for maintaining said bearing structure, said mounting bracket, said plate structure, and said operating shaft together as a preassembled unit prior to installation of the bar lock assembly onto said panel.

2. The bar lock assembly according to claim 1 wherein said coupling comprises adhesive disposed between a surface on said one leg of each of said L-shaped brackets arranged in confronting relation relative to the respective flanges on said mounting bracket whereby operably securing said brackets to the flanges of said mounting bracket to form said preassembled unit.

* * * * *